US011352776B2

(12) United States Patent
Norton

(10) Patent No.: US 11,352,776 B2
(45) Date of Patent: Jun. 7, 2022

(54) ARTICLE AND METHOD FOR CONSTRUCTING, DECONSTRUCTING AND RECONSTRUCTING TEMPORARY STRUCTURES

(71) Applicant: The Step 2 Company, LLC, Streetsboro, OH (US)

(72) Inventor: John Jeffrey Norton, Kent, OH (US)

(73) Assignee: THE STEP 2 COMPANY, LLC, Streetsboro, OH (US)

( * ) Notice: Subject to any disclaimer, the term of this patent is extended or adjusted under 35 U.S.C. 154(b) by 14 days.

(21) Appl. No.: 16/839,288

(22) Filed: Apr. 3, 2020

(65) Prior Publication Data

US 2020/0318340 A1 Oct. 8, 2020

Related U.S. Application Data

(60) Provisional application No. 62/829,279, filed on Apr. 4, 2019.

(51) Int. Cl.

| | |
|---|---|
| ***E04B 1/34*** | (2006.01) |
| ***E04B 1/343*** | (2006.01) |
| ***E04H 1/12*** | (2006.01) |
| ***A63H 33/04*** | (2006.01) |
| ***A63H 33/08*** | (2006.01) |

(Continued)

(52) U.S. Cl.

CPC ..... *E04B 1/34321* (2013.01); *A63H 33/008* (2013.01); *A63H 33/044* (2013.01); *A63H 33/08* (2013.01); *E04B 1/34331* (2013.01); *E04B 1/34384* (2013.01); *E04H 1/1205* (2013.01);

(Continued)

(58) Field of Classification Search

CPC ..... E04B 1/34321; E04B 1/34331; E04B 1/34326; E04B 1/34384; E04B 1/612; E04B 2001/34389; A63H 33/08–088

See application file for complete search history.

(56) References Cited

U.S. PATENT DOCUMENTS 2,059,598 A * 11/1936 Paulson ..... A63H 33/04 446/106
2,110,990 A * 3/1938 Forbes ..... A63H 33/04 446/106

(Continued)

FOREIGN PATENT DOCUMENTS

GB 2274789 A * 8/1994 ..... A63H 33/044

*Primary Examiner* — Adriana Figueroa

(74) *Attorney, Agent, or Firm* — Emerson, Thomson & Bennett, LLC; Roger D. Emerson

(57) ABSTRACT

Provided herewith is a system for assembling a temporary structure using a plurality of separate members. A first member has ends at opposite sides of an elongated body portion, with notches on the top and bottom sides of each end. A second member has ends with notches formed on opposite between the ends. These notches enable the first and second members to engage with other such separate members. A third member has a triangular shape that functions as a roof truss with opposing sloped surfaces and an underside. A pair of truss notches is formed at positions corresponding to the notches of the first member, for each engaging with one of the plurality of separate members. The third member also includes feature hooks, formed on the sloped surfaces, for engaging with a fourth member defined by a planar roofing material having a plurality of holes.

15 Claims, 22 Drawing Sheets

(51) Int. Cl.
*A63H 33/00* (2006.01)
*E04B 1/61* (2006.01)

(52) U.S. Cl.
CPC ..... *E04B 1/34326* (2013.01); *E04B 1/612* (2013.01); *E04B 2001/34389* (2013.01)

(56) References Cited

U.S. PATENT DOCUMENTS

| | | | | |
|---|---|---|---|---|
| 4,372,076 | A * | 2/1983 | Beck | A63H 33/06 446/106 |
| 5,174,078 | A * | 12/1992 | West | A63H 33/008 446/106 |
| 6,059,630 | A * | 5/2000 | Paxton | A63H 33/044 446/106 |
| 6,189,271 | B1 * | 2/2001 | Christensen | E04B 2/702 446/106 |
| 6,923,705 | B2 * | 8/2005 | DeSalvo | A63H 33/044 446/106 |
| 9,032,670 | B2 * | 5/2015 | Vogler | E04H 1/005 52/79.9 |
| 9,327,206 | B2 * | 5/2016 | Donohoe | A63H 33/084 |
| 9,737,825 | B2 * | 8/2017 | Donohoe | A63H 33/044 |
| 10,183,229 | B2 * | 1/2019 | Donohoe | A63H 33/086 |
| 2012/0000142 | A1 * | 1/2012 | McKimmy | E04H 1/1205 52/79.1 |
| 2012/0110926 | A1 * | 5/2012 | Phillips | E04H 1/1205 52/79.9 |
| 2013/0000218 | A1 * | 1/2013 | Uffner | E04B 1/34321 52/79.1 |
| 2016/0214024 | A1 * | 7/2016 | Kiley | A63H 33/065 |
| 2019/0091596 | A1 * | 3/2019 | Cecchin | A63H 33/042 |

* cited by examiner

ARTICLE AND METHOD FOR CONSTRUCTING, DECONSTRUCTING AND RECONSTRUCTING TEMPORARY STRUCTURES

CROSS-REFERENCE TO RELATED APPLICATIONS

This application claims the benefit of U.S. Provisional Application No. 62/829,279, entitled ARTICLE AND METHOD FOR CONSTRUCTING, DECONSTRUCTING AND RECONSTRUCTING TEMPORARY STRUCTURES, filed Apr. 4, 2019, which is fully incorporated herein by reference.

I. BACKGROUND

A. Field of Invention

This invention pertains to the art of articles and methods for using same to selectively and repeatedly construct, deconstruct, and reconstruct temporary compositions, such as structures. The articles feature pins, holes to receive the pins, and a variety of structural elements which enable the articles to be assembled, disassembled, and reassembled using manually generated forces and without the need for tools. These structures so assembled can be used for a variety of purposes including blinds for hunting, playground structures for children's play, temporary structures for outdoor events such as high school graduations, weddings and the like, temporary or semi-permanent structures such as sheds and storage facilities, structures for use outdoors, such as for military or camping purposes, temporary living arrangement, structures for disaster relief, or military purposes. Other uses are contemplated, and the invention would be appropriate for a myriad of uses where temporary structures, especially outdoor, are desirable.

B. Description of the Related Art

It is known to provide temporary housing, especially for outdoor applications, such as canvas tents. It is also known to provide building blocks and children's toys that are small and able to be used by children's hands to make play structures, but generally, not large enough for the child, or an adult to occupy. For example, wooden and plastic building blocks, have been used to make small compositions, such as might sit on a table top and used by children to pretend and imagine, but would be of a size to accommodate only smaller toy soldiers or figurines.

What is needed, then, is an article, or series of articles, that can be selectively and repeatedly assembled into various configurations, and then easily deconstructed, transported as desired, and then repeatedly constructed and deconstructed to provide structures, especially outdoors. Also, it would be advantageous for these articles to be of a configuration to allow a variety of structures to be made, not just a single or a few designs. Rather, if the articles are properly constructed, a myriad of structures with various configurations are possible.

II. SUMMARY

A system is disclosed for assembling a temporary structure. The system includes a plurality of separate members that are engaged together to assemble the temporary structure. The separate members include one or more first members, one or more second members, one or more third members, and one or more fourth members. These members can be sold as a set or a kit that include specified, predetermined numbers of each type of separate members.

The first member has a generally elongated body portion extended along a longitudinal axis. The first member includes a first end and a second end at opposite sides of the elongated body portion. First and second notches are formed respectively on opposite obverse and reverse sides (i.e., top and bottom sides) of the elongated body portion. A first pair of first and second notches are formed substantially adjoining the first end, and a second pair of first and second notches are formed respectively substantially adjoining the second end.

A pin is formed within the first notch of one or both of the first and second pairs of notches. The pin is formed to be received within a respective mating hole on one of the plurality of separate members, to engage the first member and the respective separate member together, which is to say, to join together these respective members. A mating hole is formed within the second notch of one or both of the first and second pairs of notches. The mating hole is formed to receive a respective pin formed on one of the plurality of separate members, to engage the first member and the respective separate member together, which is to say, to join together these respective members.

The second member has a first end and a second end. The second member includes first and second notches, formed respectively on opposite obverse and reverse sides of the second member (i.e., top and bottom sides), between the first end and the second end. A pin is formed within the first notch of the second member. The pin is formed to be received within a respective mating hole in one of the plurality of separate members, to engage the second member and the respective separate member together, which is to say, to join together these respective members. A mating hole formed within the second notch of the second member. The mating hole is formed to receive a respective pin formed on one of the plurality of separate members, to engage the second member and the respective separate member together, which is to say, to join together these respective members.

The third member has a triangular shape that functions as a roof truss. The third member includes a first surface and a second surface, oriented to form opposing sloped surfaces of adjoining sides of the triangular shape. A third surface defines an underside of the triangular shape, and has a pair of truss notches at positions corresponding respectively to the pairs of notches of the first member, for each engaging with one of the plurality of separate members, which is to say, to join together these respective members.

One or both of a pin or a hole are formed within one or both of the pair of truss notches, for engaging a respective hole or pin on one of the plurality of separate members, to engage the third member and the respective separate member together, which is to say, to join together these respective members. A plurality of feature hooks are formed on the first and second surfaces, for engaging with the fourth member. The fourth member is a planar roofing material having a plurality of holes, to engage the feature hooks on one of the first and second surfaces of the third member, which is to say, to join together these respective members.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

With reference to FIG. 1-15, the innovative articles and method for using them are illustrated.

Figure 1:
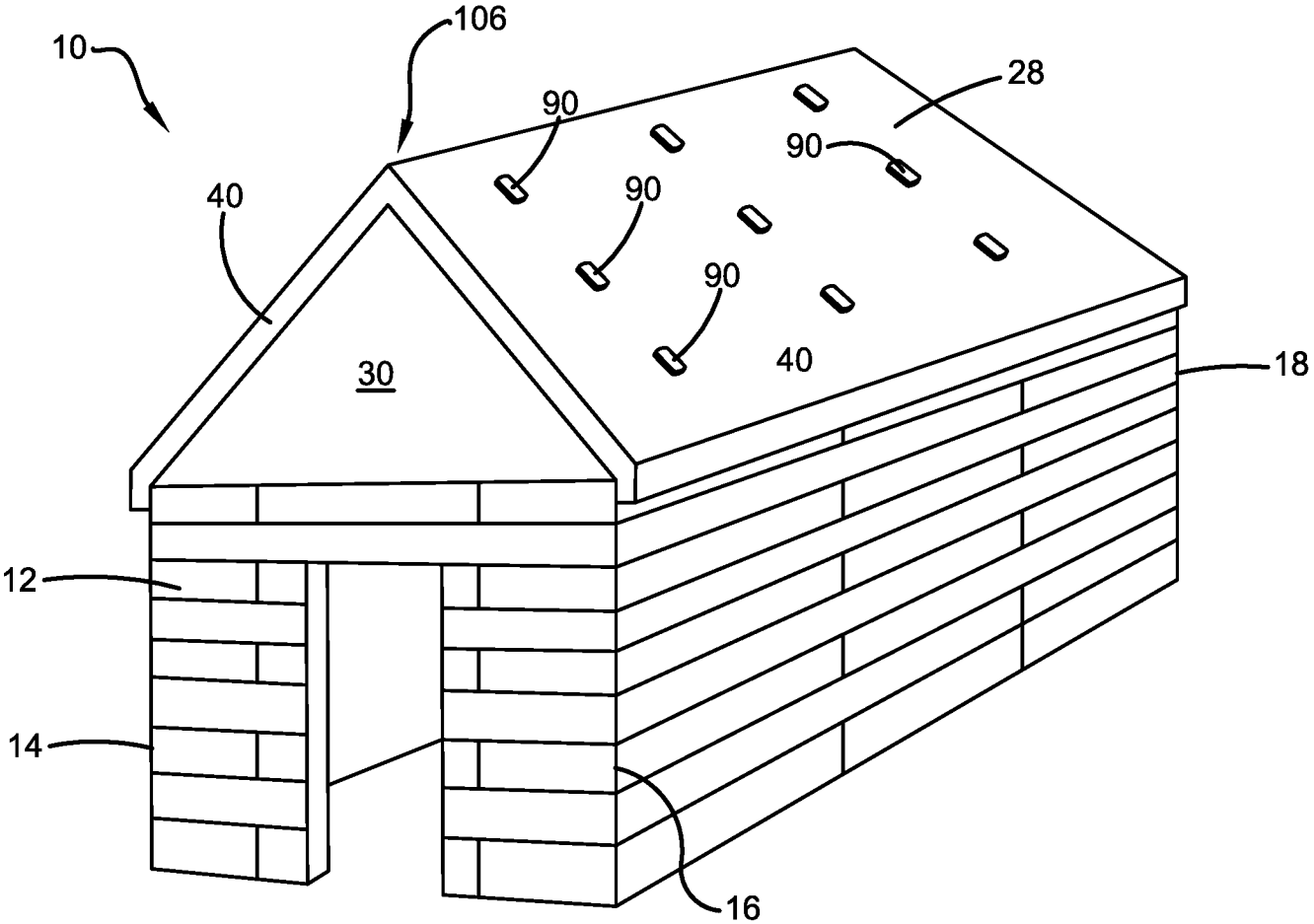
FIG. 1 is a perspective view of a structure showing first, second, third, and fourth members assembled to form one version of a structure.

With particular reference to FIG. 1, one embodiment of an assembled structure is illustrated. The structure 10 features horizontally-extending first members 12 which are joined at corners 14, 16, 18, and 20 (20 is hidden). In the embodiment shown, a peaked roof 28 is formed by a triangular-shaped third member 30, which is selectively covered by planar roofing material 40.

With reference to FIGS. 1-15, individual components are shown and will be discussed.

Figure 2:
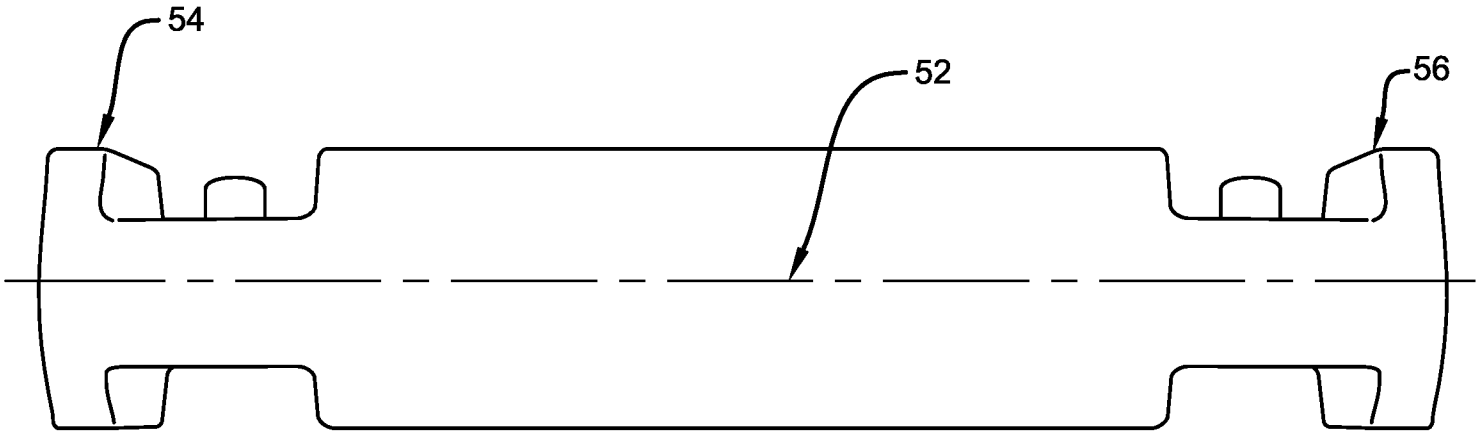
FIG. 2 is a top perspective view of a first member.
Figure 3A:
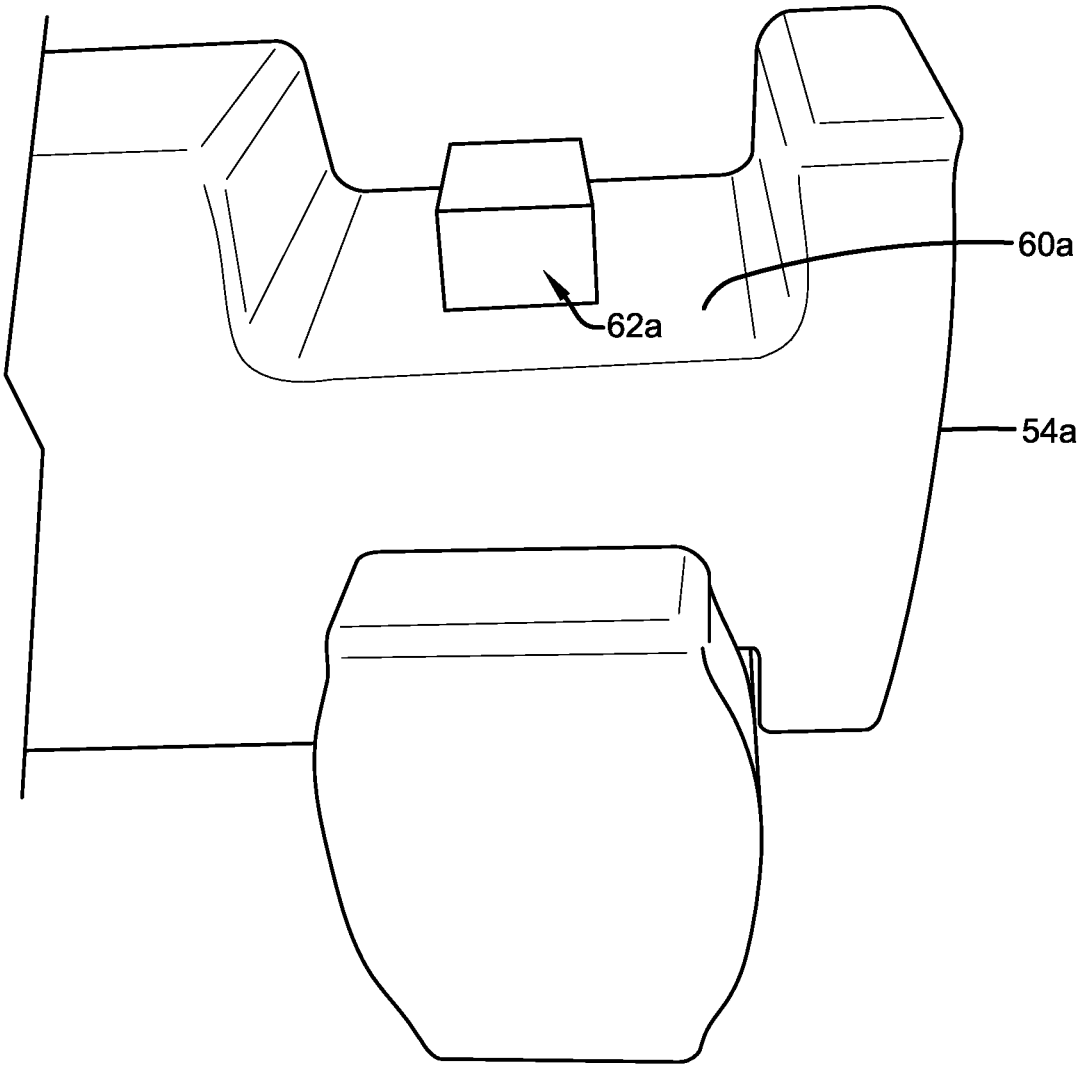
FIG. 3A shows a notch in a first member, and especially showing an alternate embodiment of a pin.
Figure 3B:
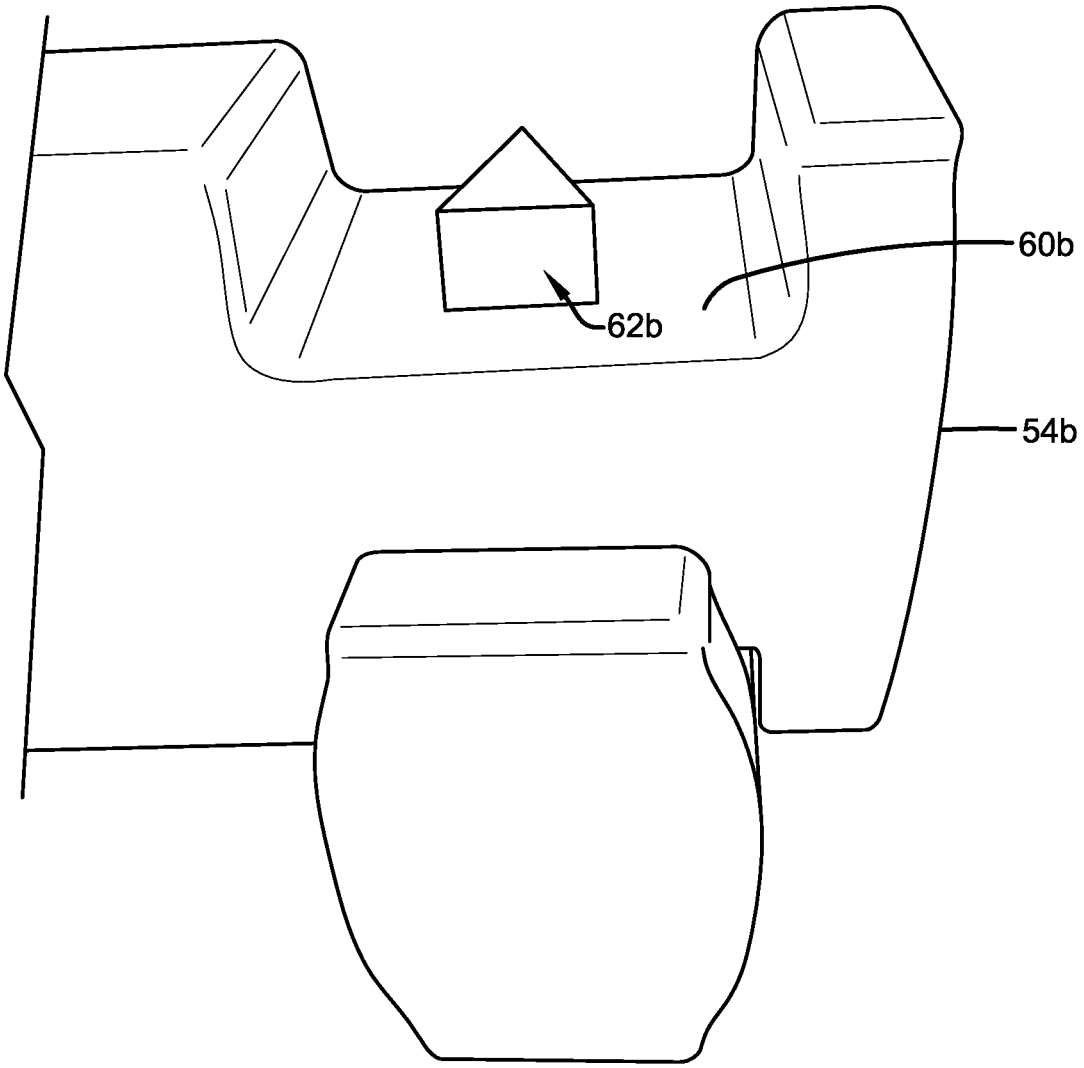
FIG. 3B shows a notch in a first member, and especially showing yet another alternate embodiment of a pin.

With reference to FIGS. 2 and 3, a first member 12 is illustrated. The first member 12 is a generally elongated body 52 having a longitudinal axis. It has a first end 54 and a second end 56. Into said first end 54 is formed a receptacle or notch 60 which can selectively correspond and cooperate with other elements of the inventive articles. In one embodiment of the notch, the vertically extended surface 63 is between 10% and 80% percent of the overall vertical dimension 112, with the currently preferred percentage being 40%. This ratio can change depending on the material used, the stress loads contemplated, and can be adjusted and chosen with sound engineering judgment based on the application.

With continuing reference to FIG. 2, a pin 62 is shown. In one embodiment, the pin 62 is shown in a cylindrical form although other shapes of pins 62 are contemplated and within the scope of the invention. For example, with reference to FIGS. 3A and 3B, the pin 62 could have a rectangular cross section or a triangular cross section, depending on the application. In the embodiment shown in FIG. 2, the pin 62 is cylindrical and has a diameter of between 0.25 inches and 3 inches. In the currently preferred embodiment, the pin 62 has a diameter of 1 inch.

Figure 4:
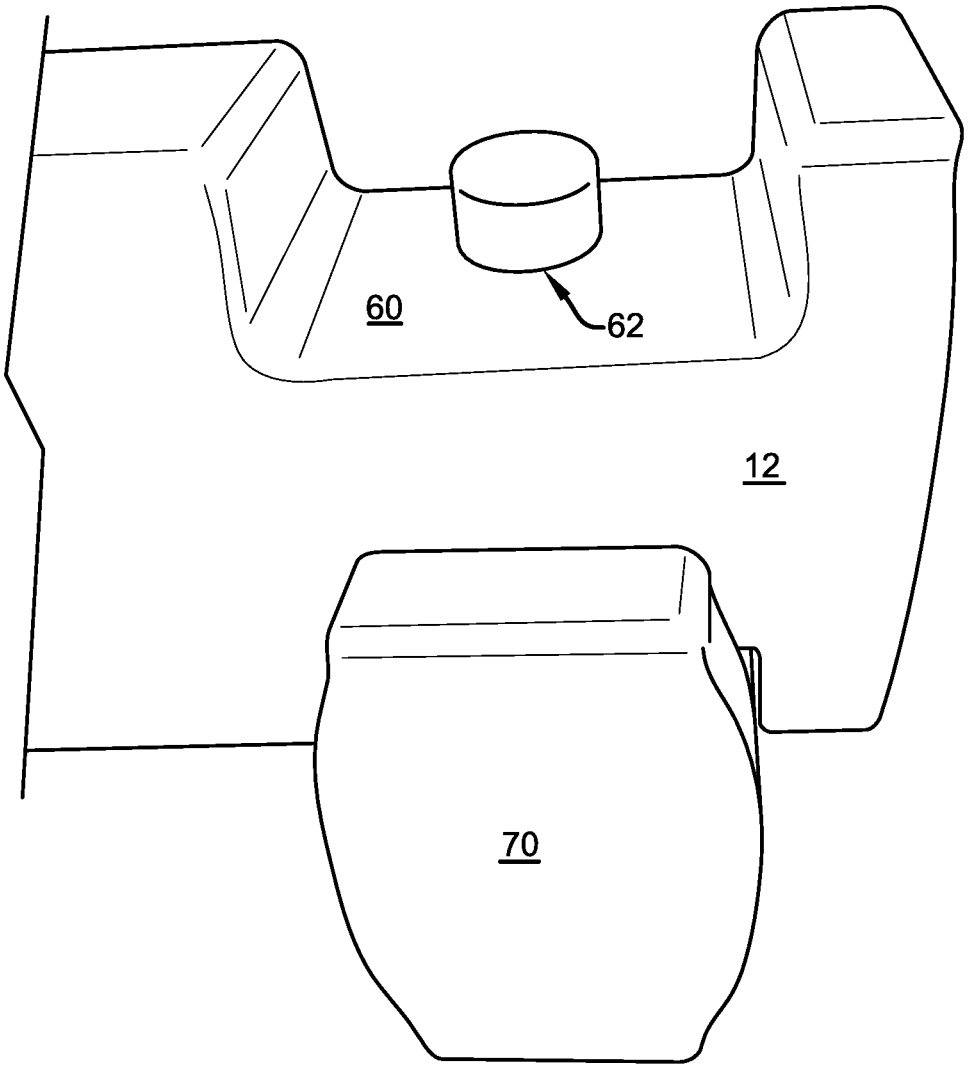
FIG. 4 shows a side perspective of a first member attaching to a second member.
Figure 5:
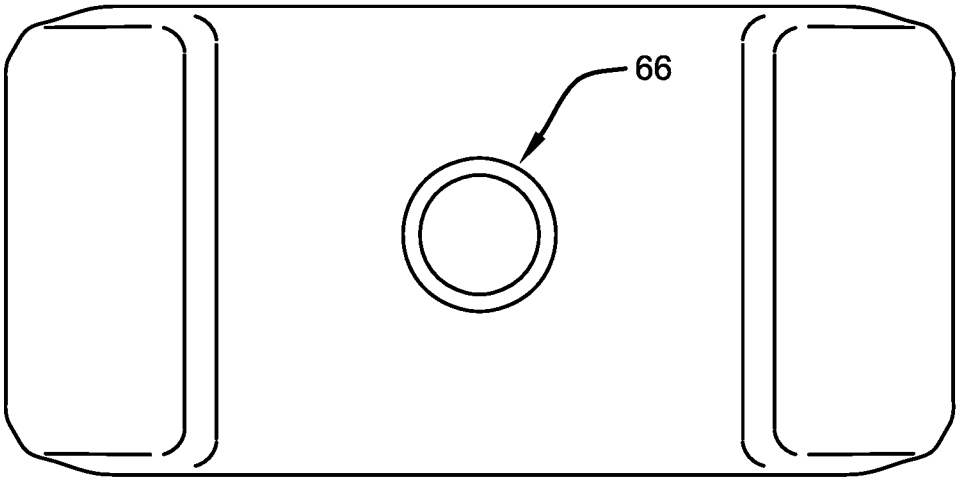
FIG. 5 is a perspective top view of a hole in second member.
Figure 6:
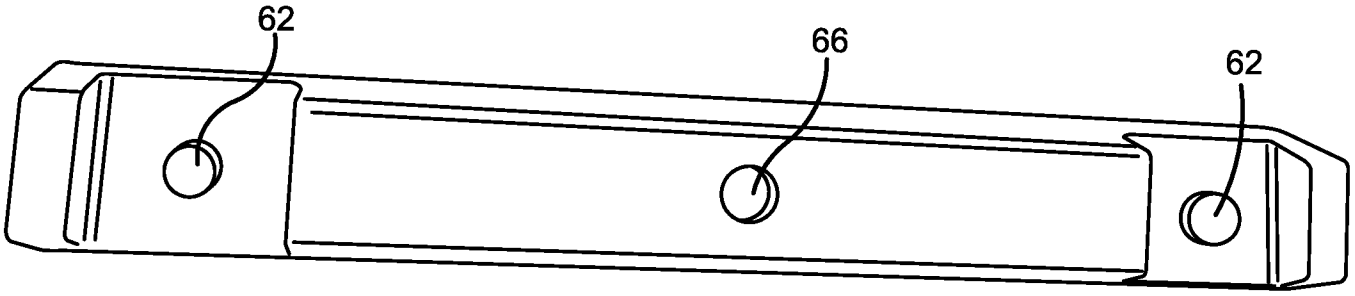
FIG. 6 shows one configuration of holes and notches for selectively attaching the first, second, third, and fourth members.

With reference to FIGS. 4, 5, and 6, the pin 62 is selectively, operatively, engaged by a hole 66 in first member 12. As will be seen later in this disclosure, other elements and members of the invention can feature notches 60, pins 62, and holes 66 in various locations, as desired, to enable many different configurations of the members of the invention, thereby enabling a wide variety of structures to be designed and constructed as the builder desires.

Figure 7:
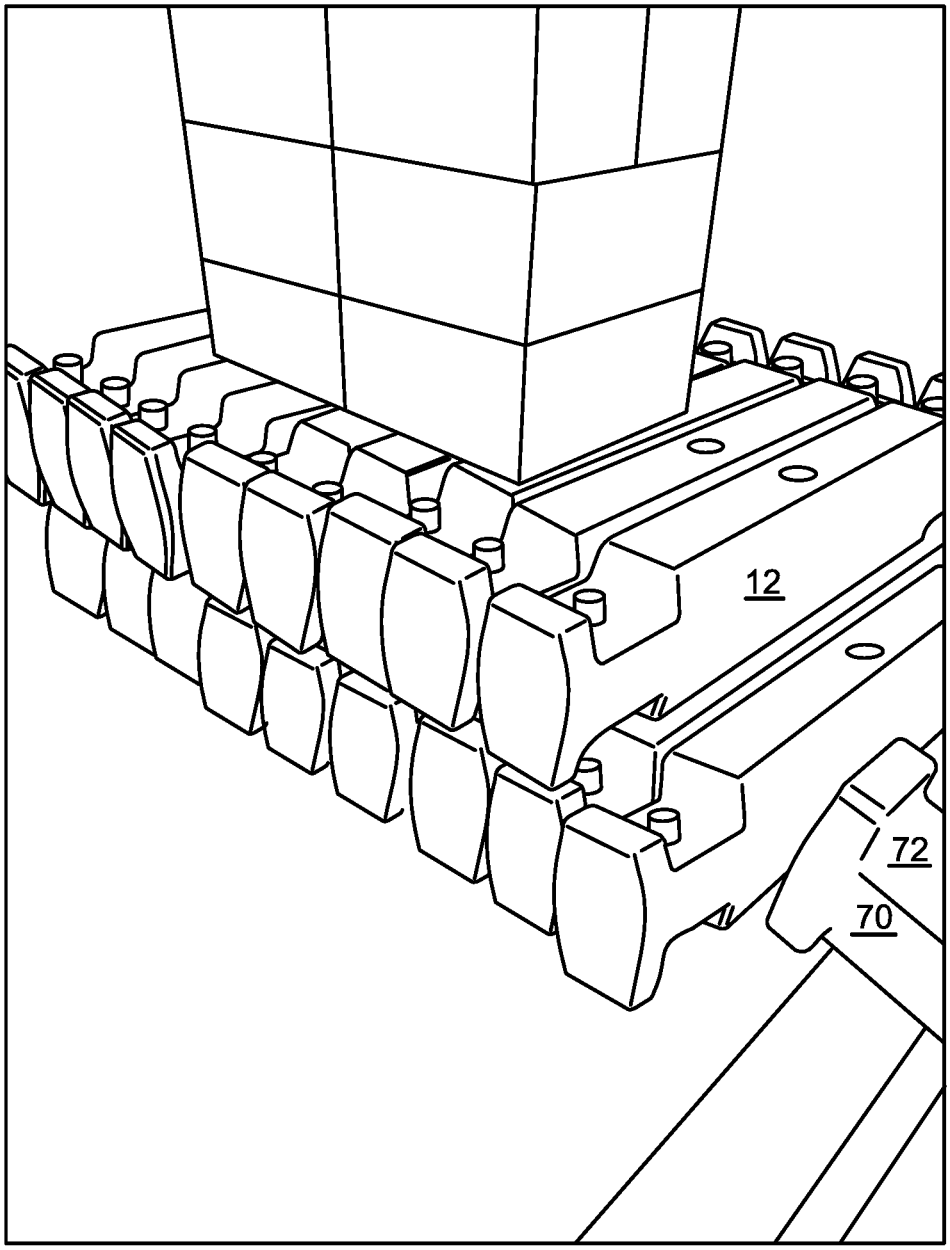
FIG. 7 shows a grouping of first members and single second member, illustrating how a group of first, second, third and fourth members could be efficiently packed and shipped.
Figure 8:
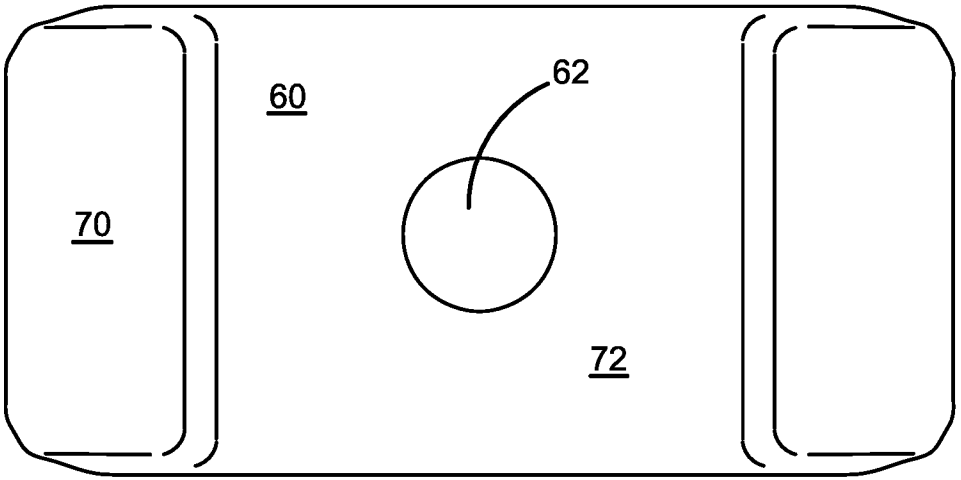
FIG. 8 illustrates a top view of a second member with a pin and notch.
Figure 9:
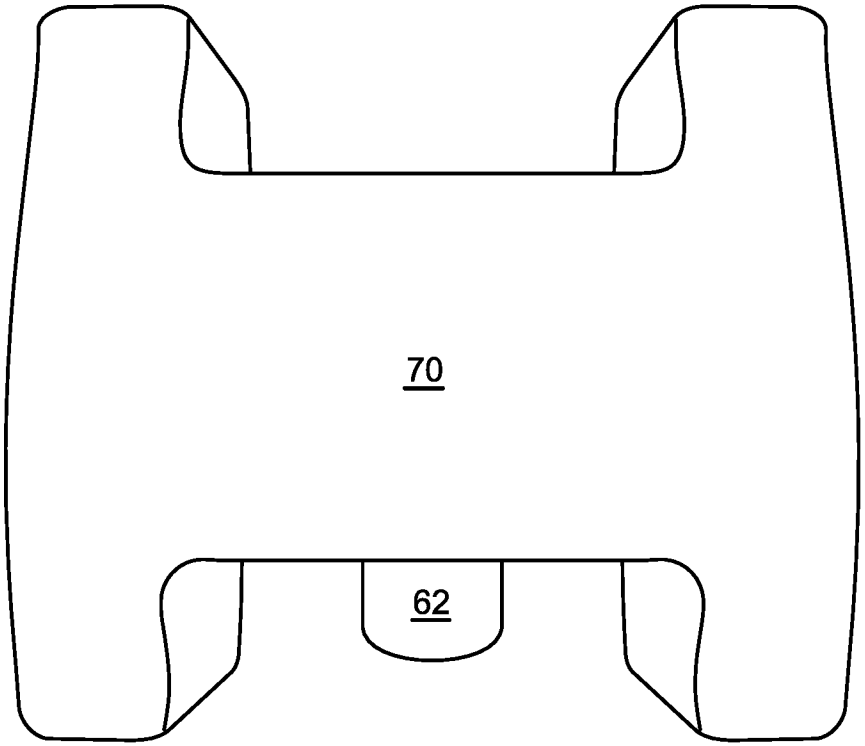
FIG. 9 is a front view of a second member.
Figure 10:
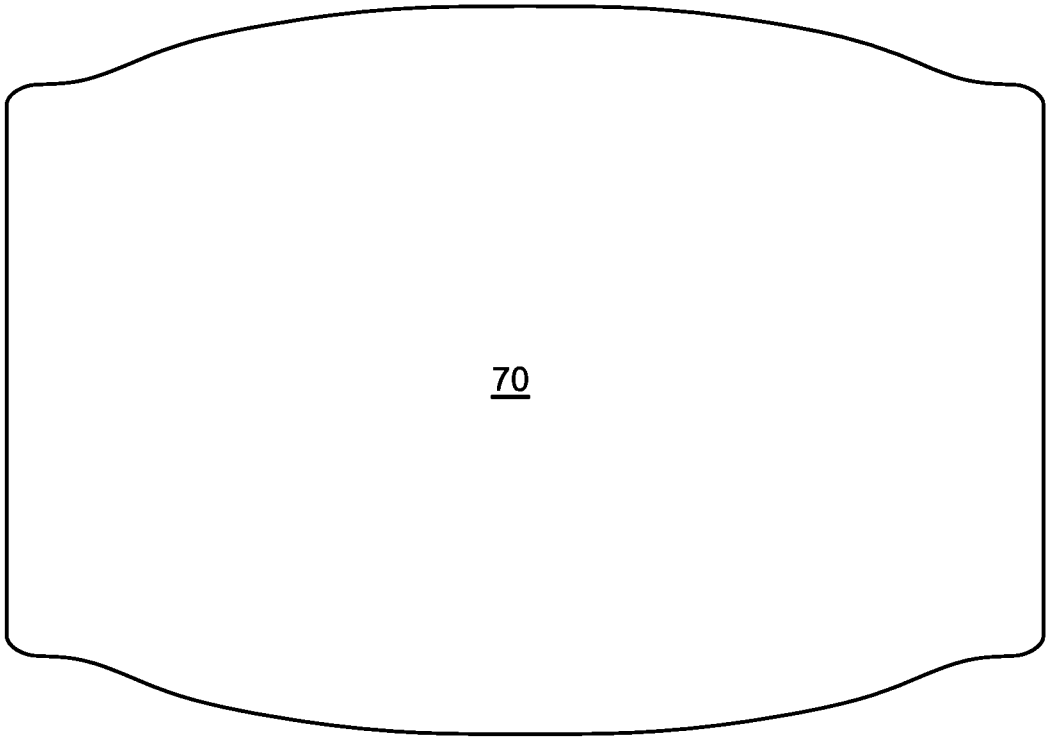
FIG. 10 shows a side view of a second member.
Figure 11:
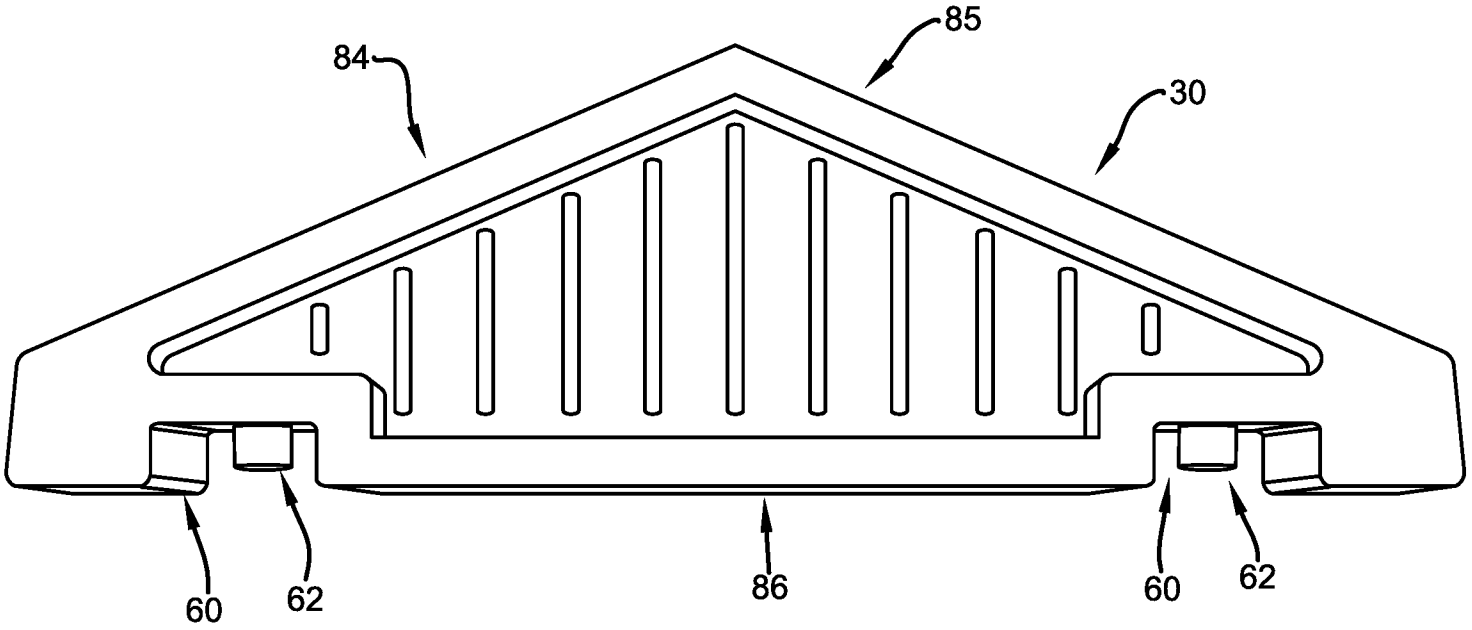
FIG. 11 is a front view of a third member.

With reference to FIGS. 4, 5, 6, and 7, second member 70 is described. The second member 70 tends to be of less longitudinal length than the first member 12. The second member 70 performs the function of providing connecting articles together, such as connecting two first members 12 at a 90-degree angle. This enables different structures to be built, by connecting first members oriented along non-longitudinal bases. For example, with reference to FIG. 4, the beginning of a corner is illustrated by the use of a first member 12 being oriented at 90 degrees to second member 70. With further reference to FIG. 7, a stack or grouping of first members 12 is shown, and a single second member 70 is also shown at 90 degrees to a first member. One can envision that a second first member 12 could now be added on top of the top surface 72 of second member 70 and the process be repeated so that a corner of a structure could be built. With reference to FIGS. 8, 9, and 10, the second member 70 is illustrated in this embodiment of the second member 70, a pin 62 extends from an upper surface 72 with reference to FIG. 4, one can see how the second member 70 and its pin 62 is received within the notch 60 on the underside of the first member 12 in the corresponding hole in that first member. FIG. 10 provides an end view of the second member 70.

Figure 12:
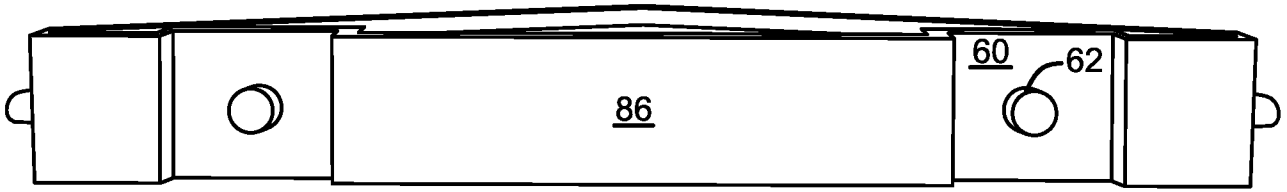
FIG. 12 is a bottom view of the third member.

With reference to FIG. 11-14, the third member 30 is illustrated and will be described. With special reference to FIG. 11, the third member usually can take a shape of a triangle and can resemble and function as a "roof truss" as is illustrated in FIG. 1. An embodiment of the third member 30 has longitudinally-extending grooves 114 in a front surface 118. The grooves 114 add strength to the third member 30 and assist in manufacturing the product in the preferred, roto molding process. The third member 30 has two notches 60 with two pins 62. The third member 30 has a first and second surface 84, 85 that are usually oriented upwardly and a third surface 86 which is normally oriented downwardly. Continuing reference to FIGS. 11-14, and especially to FIGS. 13 and 14, the first and second surfaces 84, 85 of the third member 80 also feature hooks 90. The hook does not necessarily have to assume a "c-shaped" or hook shaped orientation or configuration but simply should be positioned so that they can receive a fourth member 100. For example, with reference to FIG. 13, and FIGS. 13A and 13B, a schematic, side view of a hook 90A and 90B is shown. Each hook 90 has an extended point 128. The hooks are oriented on the surfaces 84 and 85 so that the extended points 128 are oriented toward the peak 106. This orientation, while cooperating with gravity, forces the weight of the fourth member 40 against supporting surface 136A and 136B, thereby simply and removeably fastening the fourth member 40 to the structure 10. With reference to FIG. 12, the fourth member 100 is shown in operative engagement with first and second surfaces 84, 85 of third member 30 holes 100 are cut into the surface of the fourth member 40 so as to receive the hooks 90 of the third member 30.

Figure 13:
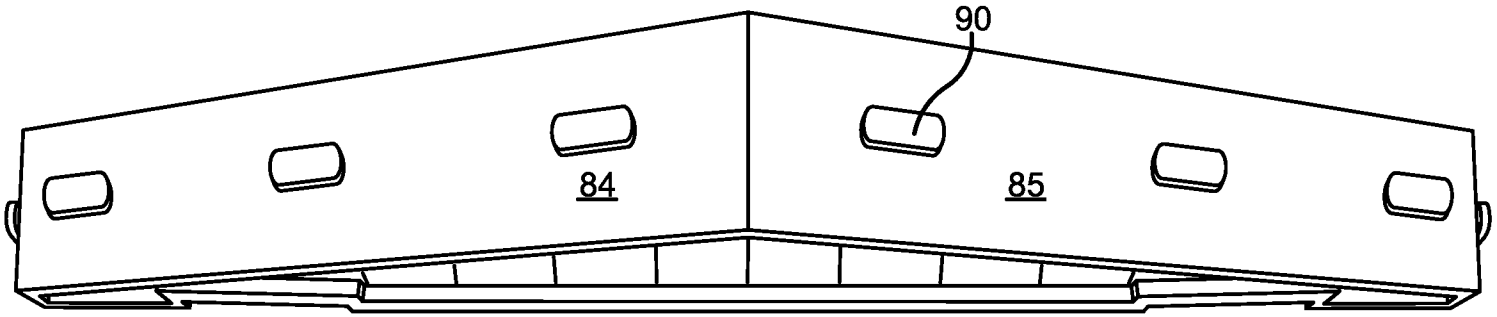
FIG. 13 shows a perspective view of the third member with hooks.
Figure 14:
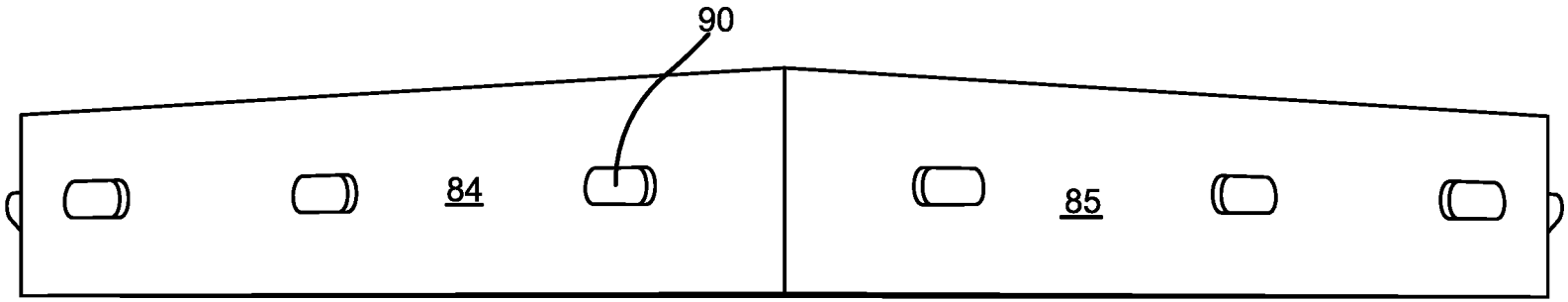
FIG. 14 shows a top view of the third member with hooks.
Figure 15:
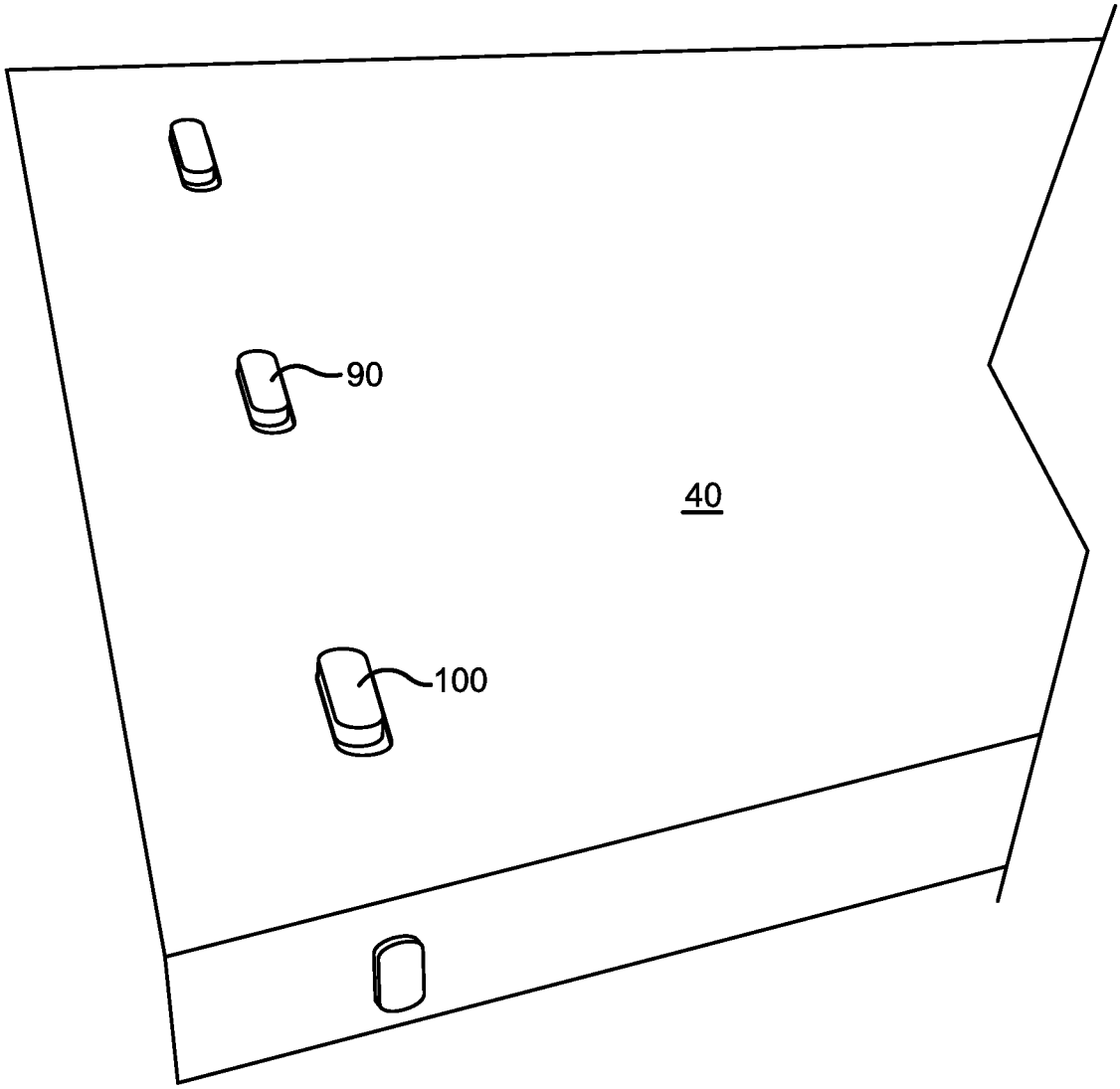
FIG. 15 shows the planar material attaching to the hooks of a third member.

With reference to FIGS. 1, 12, and 13, one can see how the fourth member 40 can be oriented and hooked onto the hooks 90 of the third member 30. The fourth member 40 is simply positioned so that holes 100 in the fourth member 40 receive the hooks 90 of the third member. By doing so, the fourth member is selectively attached to the third member 30 or, as illustrated in FIG. 1, an overall structure 10. However, removing the fourth member 40 from the structure 10 or from the third member 30 is simply a matter of sliding the fourth member upwardly toward the peak 106 of the structure until the hole 100 has cleared the hook 90, at which time the fourth member 40 is simply lifted off. In the preferred embodiment, fourth member 40 extruded plastic arranged in the configuration of corrugated planar material. A first flat sheet and a second flat sheet is separated by a corrugated member, similar to the well-known configuration of cardboard, however, the preferred form of the fourth member is corrugated plastic which makes it more water-resistant and a better choice for roofing. This provides the well-known benefit of stability and strength but light weight. However, while this configuration is commonly known in paper, such as with corrugated cardboard, this particular configuration is made of extruded plastic which enables it to be more water-resistant and an excellent choice for roofing material, for the structure 10.

The application of these elements, and the configurations possible, are varied. One application is for children to use these materials to play, enabling them to build a variety of configurations and different structures in their play. Paintball, playing "army", snowball fights, or even playing house are all facilitated and made possible by the invention coupled with the creativity of the child.

The invention is also applicable for hunting, where a hunter might wish to provide a blind for duck or deer hunting. Because of the manufacturing process used, the elements are light and easily transported, and convenience in both transportation and constructing is provided.

In the preferred embodiment, the first, second, and third element are made via a roto molding processing. The benefits of roto molding are well known, and among them is unusual strength compared to their weight. Roto molding products are light and generally large, but strong for their size. The instant invention is an excellent application of the roto molding process.

As can be illustrated with reference to FIG. 7, a variety of structural members, such as first, second, and third members could be roto molded and stacked into a compact volume. This makes shipping and transportation easy. A customer, or user, could purchase or acquire a large number of these members, in whatever arrangements and numbers are desired to build whatever structure is desired. Although these elements would be fairly large, they would be fairly light and offer an attractive strength to weight ratio, due to the plastic material and roto molding process. It is foreseen that a supply of such members could be stored at a children's camp, a playground, a backyard, a military facility, at a disaster location, such as might be utilized by a humanitarian agency for temporary housing and the like. A human, whether man or child, could quickly assemble these elements into a variety of useful configurations and build a variety of structures such as a wall for a snow ball fight, a fence for a dog, a dog house for a dog, a playhouse for a child, temporary housing for children or adults on a camping trip, etc. The usefulness of these elements will only be limited by the creativity of the user.

With reference to FIGS. 1-17, a system for assembling a temporary structure includes a plurality of separate members that are engaged together to assemble the temporary structure, wherein the separate members include one more first members 12, one or more second members 70, one or more third members 30, and one or more fourth member 40.

As also shown in FIGS. 1-17, the first member 12 has a generally elongated body portion 52 extended along a longitudinal axis. The first member 12 includes a first end 54 and a second end 54 at opposite sides of the elongated body portion. First and second notches 60 are formed respectively on opposite obverse and reverse sides of the elongated body portion 52. A first pair of first and second notches 60 are formed substantially adjoining the first end 54. A second pair of first and second notches 60 are formed respectively substantially adjoining the second end. Each of the notches 60 engage with one of the others of the plurality of separate members, which is to say, to join together these respective members.

As additionally shown in FIGS. 1-17, the second member 70 has a first end 74 and a second end 76. The second member also includes first and second notches 60, formed respectively on opposite obverse and reverse sides (i.e., top and bottom sides) of the second member 70, between the first end 74 and the second end 76, for each engaging with one of the plurality of separate members, which is to say, to join together these respective members.

As particularly shown in FIGS. 11-14, the third member 30 has a triangular shape that functions as a roof truss. The third member 30 includes a first surface 84 and a second surface 85, oriented to form opposing sloped surfaces of adjoining sides of the triangular shape. A third surface 86 defines an underside of the triangular shape, and having a pair of truss notches 60 at positions corresponding respectively to the pairs of notches 60 of the first member 12, for each engaging with one of the plurality of separate members, which is to say, to join together these respective members.

As evident from FIGS. 11-15, the third member 30 includes a plurality of feature hooks 90, formed on the first and second surfaces 84, 85, for engaging with the fourth member 40, which is to say, to join together these respective members. The fourth member 40 is a planar roofing material having a plurality of holes 100, to engage the feature hooks 90 on one of the first and second surfaces 84, 85 of the third member.

As additionally shown in FIGS. 1-17, on any of the notches 60 formed on the first member 12, the second member 70, or the third member 30, a pin 62 can be formed within the notch 60. The pin 62 is formed to be received within a respective mating hole 66 on one of the respective members 12, 70, 30, to engage the respective member and the respective separate member together. In other words, the pin 62 and the hole 64 to join together these respective members 12, 70, 40 in a snug manner, such as a removable interference connection. The pin 62 can have a cylindrical cross-section, or alternately a rectangular cross-section 62A or a triangular cross-section 62B, as respectively shown in FIGS. 3A and 3B. The pin 62, 62A, 62B preferably has a diameter of between 0.25 inches and 3 inches.

Figure 16:
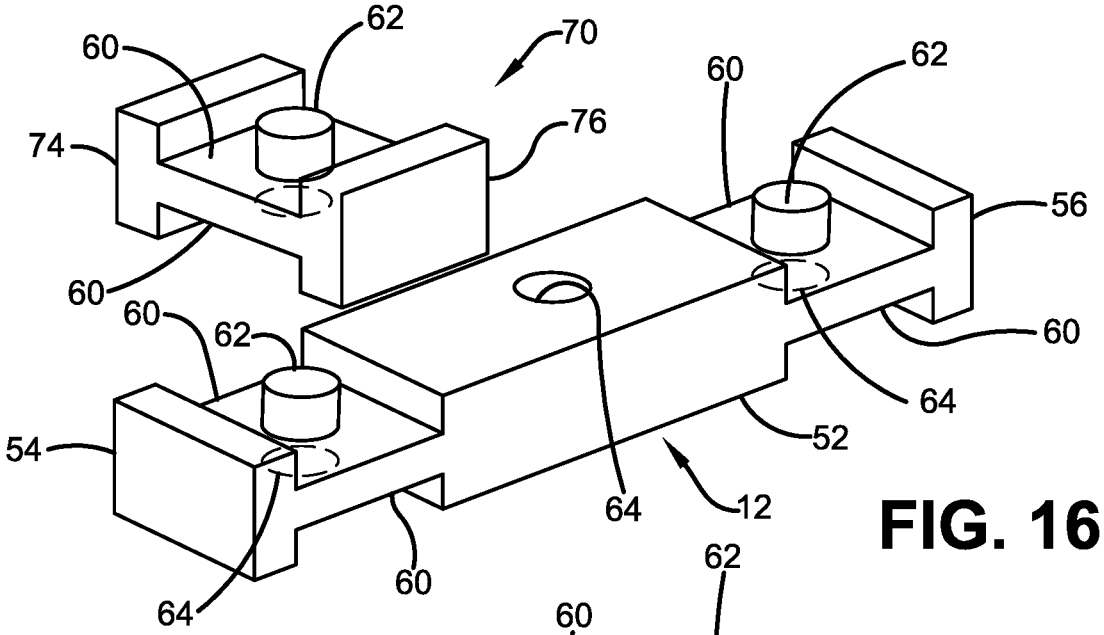
FIG. 16 shows the first member and the second member being engaged together in accordance with one embodiment of the present system.
Figure 17:
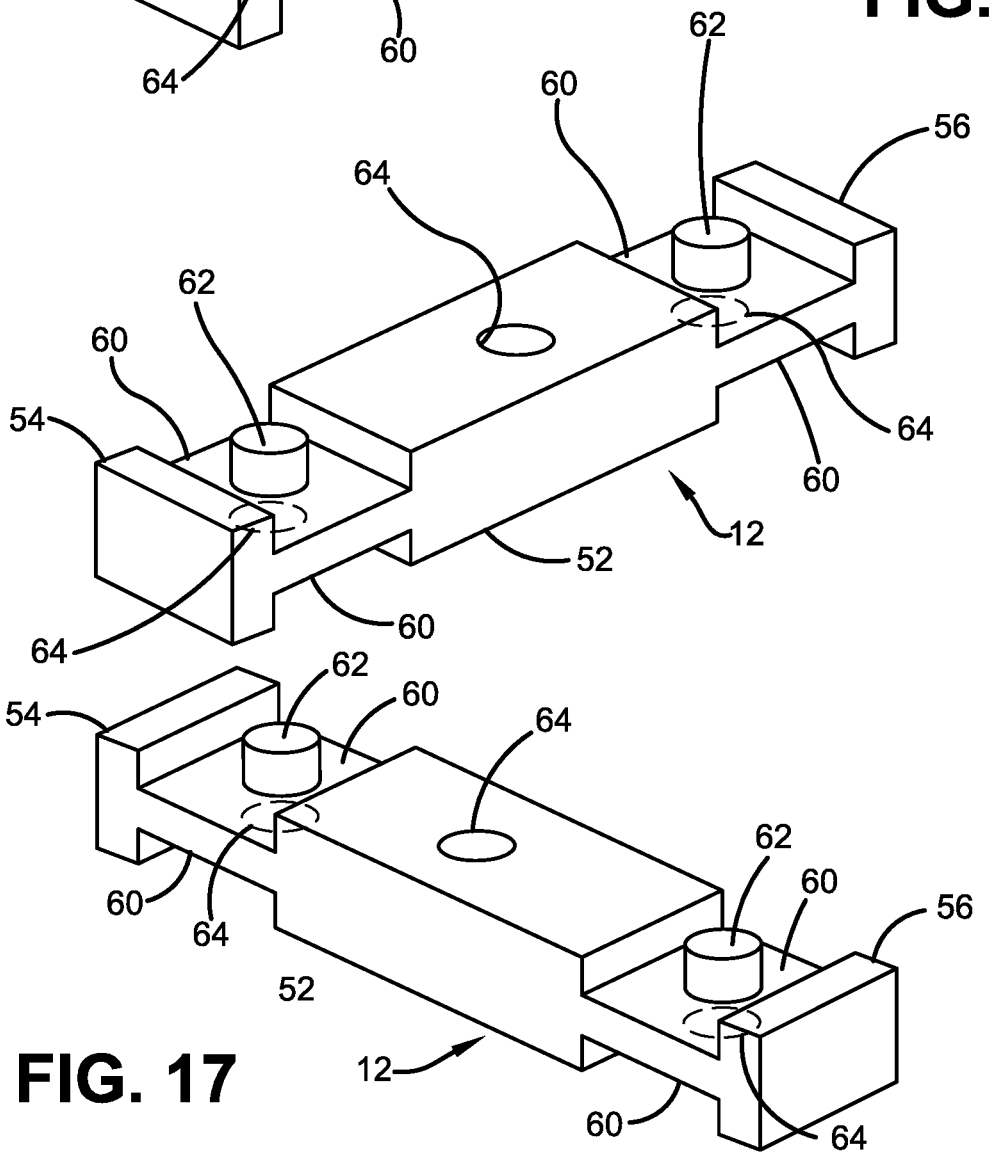
FIG. 17 shows two first members being engaged together at a 90-degree angle in accordance with one embodiment of the present system.

As particularly shown in FIGS. 16 and 17, the mating hole 64 can be formed in the elongated body portion 52 of the first member 12 at a position between the first and second ends 52, 54, for receiving a respective pin 62 formed on one of the plurality of separate members 12, 70, 30, to engage the first member 12 and the respective separate member 12, 70, 30 together, which is to say, to join together these respective members.

As further evident from FIGS. 11-15, the feature hooks 90 each have a c-shape hook profile to engage edges of the respective holes 100 of the fourth member 40. The third member 30 includes a front surface 118 with longitudinally-extending grooves 114 that add strength to the third member 30. The fourth member 40 includes a respective plurality of holes 100 substantially adjoining opposite ends so that the fourth member 40 can engage two separate third members 30 on either side.

As particularly shown in FIG. 17, a temporary structure is formed by a plurality of first members 12 where alternate first members 12 are connected at a 90-degree angle by engaging respective notches 60 on each of the first members 12, to form a corner structure. It is to be appreciated that the arrangement shown in FIG. 17 could be repeated indefinitely by stacking another respective first member 12 on top of a perpendicular first member 12 and parallel to a first member 12 below by engaging the respective notches 60. This process can be continued indefinitely by adding subsequent additional first members 12, in order to assemble a temporary corner structure of any desired height.

As particularly shown in FIG. 16, a temporary structure formed by a plurality of first members 12 and second members 70 where the first members 12 are stacked in alignment of each elongated body portion 52 with second members 70 oriented at 90-degrees so that the first and second members 12, 70 are engaged in respective notches 60, to form a wall structure. It is to be appreciated that the arrangement shown in FIG. 16 could be repeated indefinitely by stacking another respective first member 12 on top of the second 70 by engaging the respective notches 60. This process can be continued indefinitely by adding subsequent additional second members 70 and first members 12, in the illustrated manner, in order to assemble a temporary wall structure of any desired height.

FIGS. 18-22 depict an alternative embodiment of a structure 10 showing first, second, third and fourth members 12, 70, 30, 40 assembled to form another version of a structure 10 compared to that of the aforementioned embodiments. As indicated in the figure, the structure 10 is formed by double-wide first members 12*a* that define a base. The double-wide first members 12*a* include a third pair of first and second notches 60 formed substantially along a center of the elongated body portion 52. Each of these notches 60 in the center engage with other separate members.

Corners of the structure 10 are formed by first members 12, 12*a* set at a 90-degree angle, as explained hereinabove in connection with FIG. 17. Walls are formed by stacking the double-wide first members 60*a* in the manner explained hereinabove in connection with FIG. 16, by having second members 70 engaging the notches 60 of the center. In other portions of the structure 10, the second members 70 can cap off the ends of regular first members 12 to define a shorter wall section. As also shown in FIG. 18, three third members 30 are provided to support a roof of the structure 10, each of which engage respective notches 60 of double-wide first members 12*a* defining a top perimeter of the walls.

Figure 19:
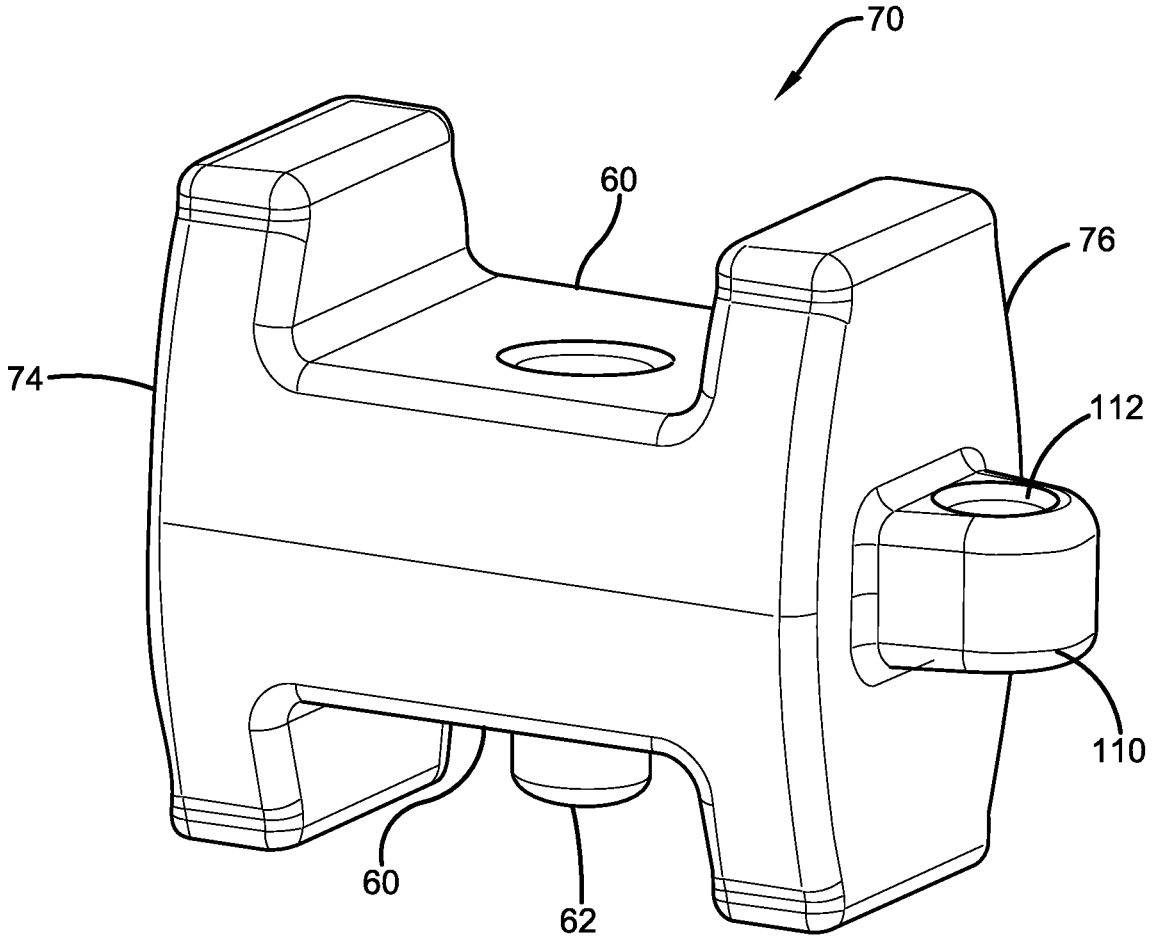
FIG. 19 is a perspective view of a second member having a pivot for supporting a door or shutter in accordance with the alternative embodiment of FIG. 18.

FIG. 19 shows a second member 70 having a pivot 110 for supporting a fifth member 120, as explained herewith. The pivot 110 can be formed on one of the first or second ends 74, 74 of the second member 70. The pivot 110 is configured to engage a hinge 122 formed on the fifth member 120. The pivot 110 can include a recess 112, which is a type of female connector that can engage a male connector on the hinge 122. Alternatively, a male connector can be included on the pivot 110 for engaging a female connector on the hinge 122.

Figure 20:
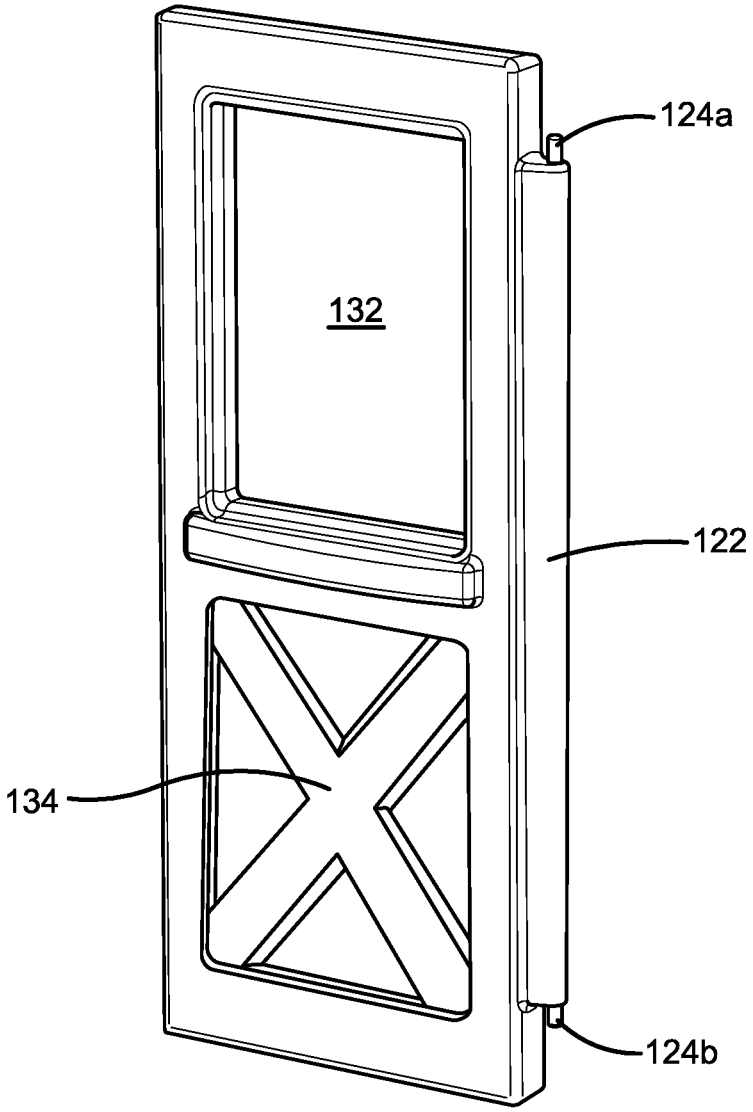
FIG. 20 is a perspective view of a door to be supported by the pivot of the second member of FIG. 19 in accordance with the alternative embodiment of FIG. 18.
Figure 21:
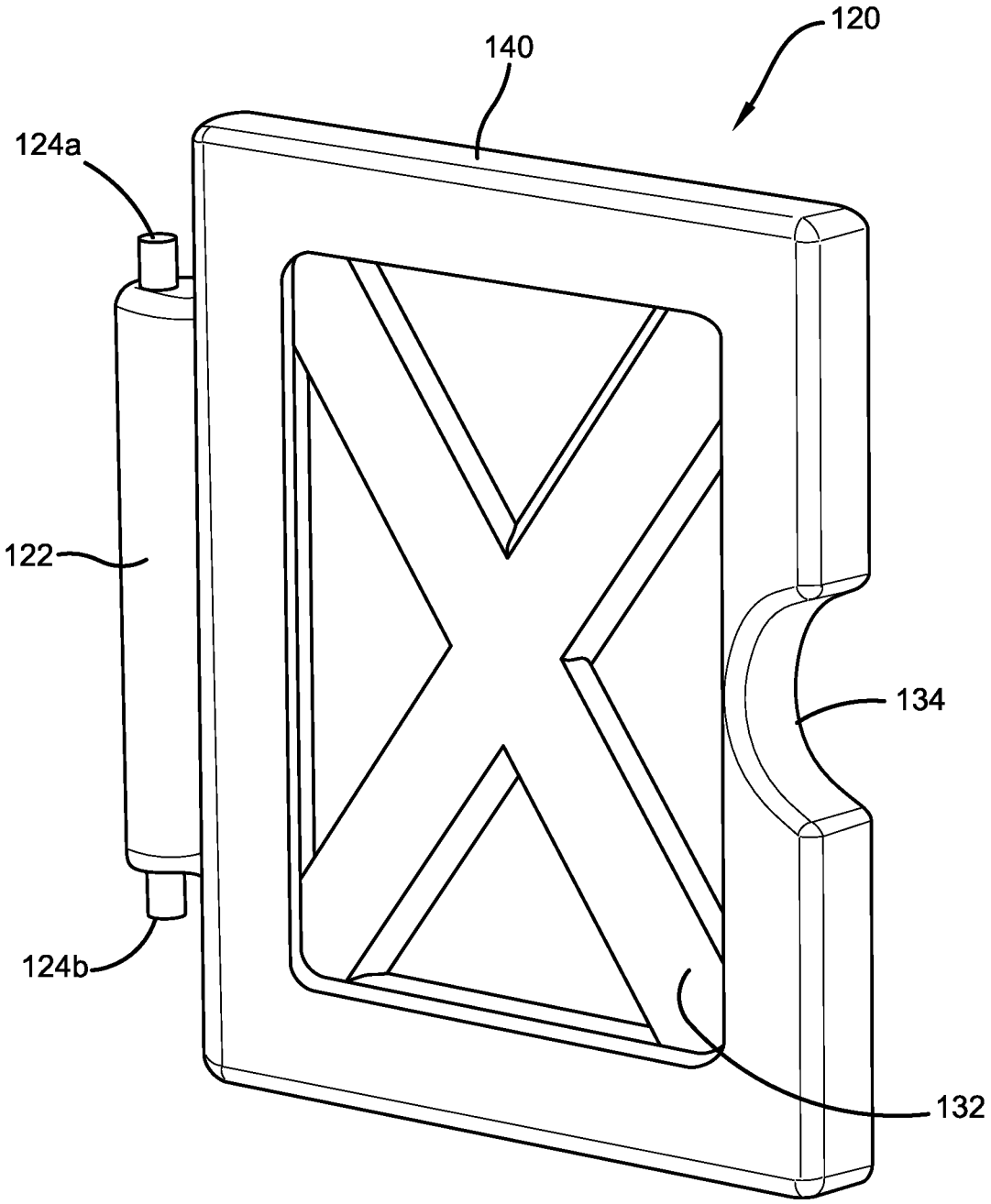
FIG. 21 is a perspective view of a shutter to be supported by the pivot of the second member of FIG. 19 in accordance with the alternative embodiment of FIG. 18.

FIG. 20 shows a type of fifth member 120 in the form of a door 130 to be supported by the pivot 110 of the second member 70. Similarly, FIG. 21 shows a type of fifth member 120 in the form of a shutter 140 to be supported by the pivot 110 of the second member 70. The hinge 122 of the fifth member 120 includes first and second projections 124*a*, 124*b*, which are a type of male connector mentioned hereinabove, formed on opposite ends of the hinge 122, and preferably pointed in opposite directions. The first and second projections 124*a*, 124*b* engage respective pivots 110 formed on a spaced-apart pair of second members 70.

Figure 18:
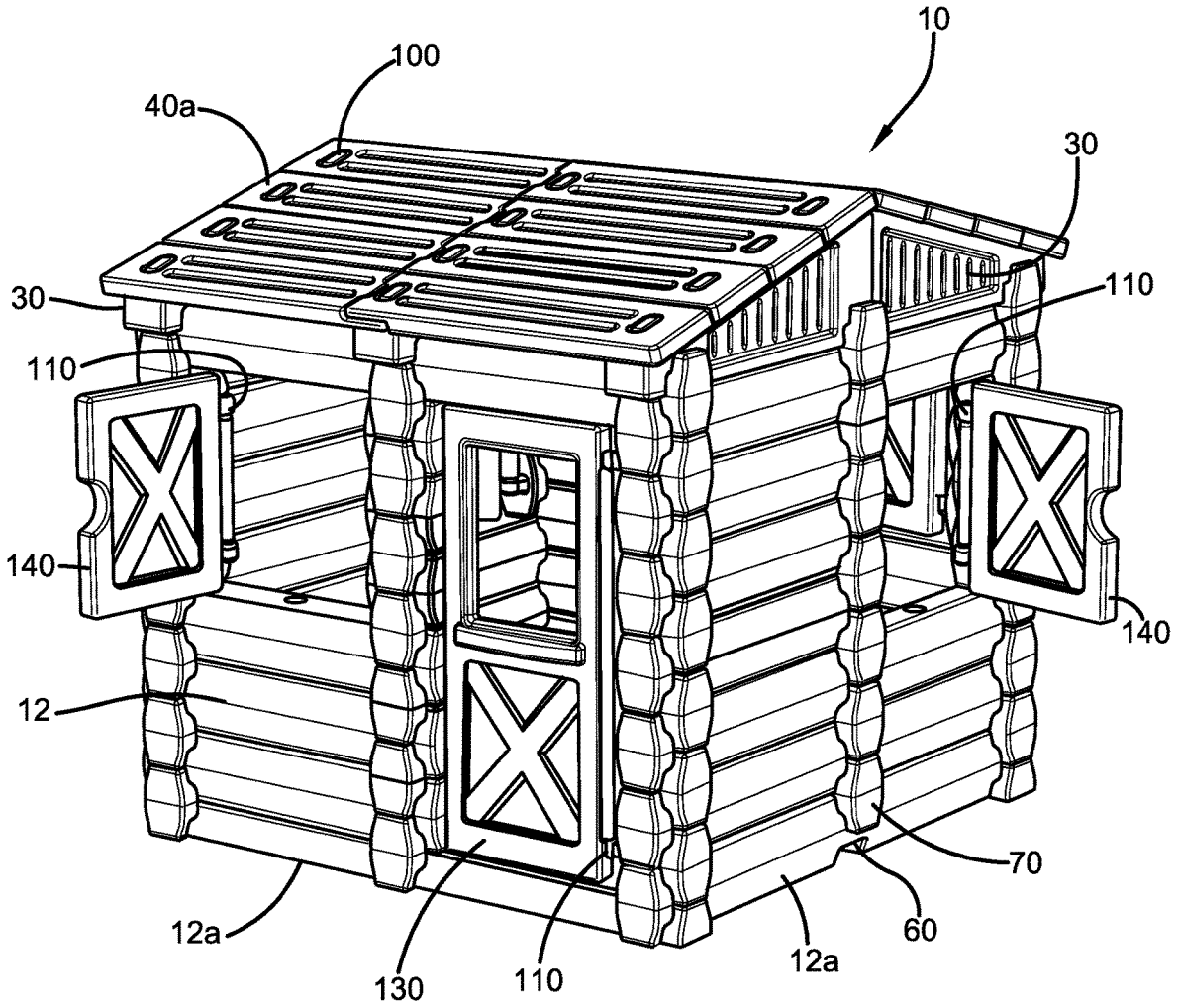
FIG. 18 is a perspective view of an alternative embodiment of a structure showing first, second, third and fourth members assembled to form another version of a structure.

As depicted in FIG. 18, the pivots 110 are formed on respective second members 70 so that a pair of second members 70 is spaced apart by a suitable number of units to be properly aligned for engagement respectively with the first and second projections 124*a*, 124*b*. For example, as indicated in the figure, the shutter 140 is positioned with the pivots 110 of two second members 70 spaced apart so that a single second member 70 is in the space between. However, the door 130 is positioned with the pivots 110 of two second members 70 spaced apart so that four second members 70 are in the space between.

As shown in FIGS. 20 and 21, the fifth members 120 include additional features. The door 130 includes a window in the form of an opening, and also a panel 134 having an x-shaped feature. The shutter door 140 includes a panel 142 having an x-shaped feature and also an accessway 134 for opening and closing the shutter 140. Both the door 130 and the shutter 140 can swing along the hinge 122 in order to open and close.

Figure 22:
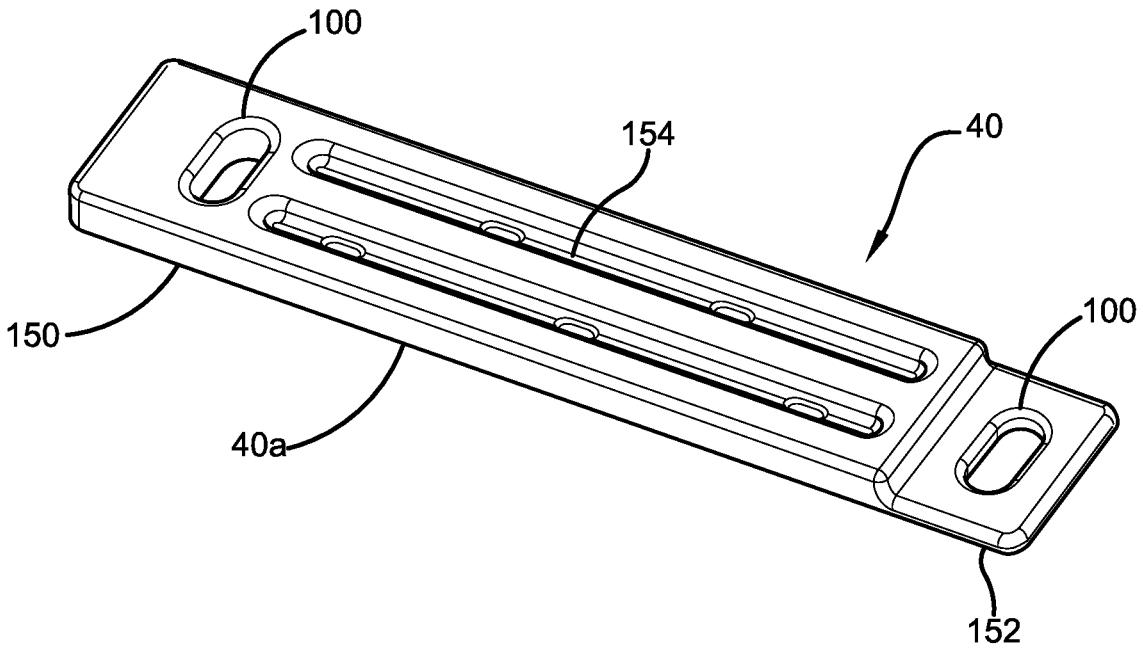
FIG. 22 is a perspective view of a roof panel for use with the structure of the alternative embodiment of FIG. 18.

In FIG. 22, a fourth member 40 in the form of a roof panel 40*a* is shown for use with the structure 10 of the alternative embodiment of FIG. 18. In this embodiment, the roof panel 40*a* has opposite ends 150, 152, each having a single hole 100 to engage respective feature hooks 90 on opposite third members 30. In this manner, a plurality of roof panels 40*a* are used to form a roof section along a single one of the first and second surfaces 84, 85 by spanning the separation between two third members 30. Horizontal features 154 are formed to provide additional rigidity and also for aesthetics.

As also evident from FIGS. 18 and 22, a horizontal section of roof is formed by a first roof panel 40*a* engaging a second roof panel 40*b*. The opposite ends 150, 152 of the roof panel 40*a* include a full thickness end 150 and a half thickness end 152. The full thickness end 150 defines an external edge of the roof, where the roof terminates. A half thickness end 152 defines an interior portion of the roof. The half thickness end 152 of a second roof panel 40*a* is placed upside down atop the half thickness end 152 of the first roof panel 40*a*, so that the half thickness ends overlap. In this overlapping the holes 100 of the respective half thickness ends 152 are aligned on the first and second roof panels 40*a*, so that they both engage the same feature hook 90. In this manner, the first and second roof panels 40 form a continuous horizontal section of roof.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

I claim:

1. A system for assembling a temporary structure, comprising: a plurality of separate members that are engaged together to assemble the temporary structure, wherein the separate members comprise at least one first member, at least one second member, at least one third member, and at least one fourth member, wherein the first member has a generally elongated body portion extended along a longitudinal axis, the first member including, a first end and a second end at opposite sides of the elongated body portion, first and second notches, formed respectively on opposite obverse and reverse sides of the elongated body portion, wherein a first pair of the first and second notches are formed substantially adjoining the first end, and a second pair of the first and second notches are formed respectively substantially adjoining the second end, for each engaging with one of the plurality of separate members;

wherein the second member has a first end and a second end, the second member including, first and second notches, formed respectively on opposite obverse and reverse sides of the second member, between the first end and the second end, for each engaging with one of the plurality of separate members, wherein the third member has a triangular shape that functions as a roof truss, the third member including, a first surface and a second surface, oriented to form opposing sloped surfaces of adjoining sides of the triangular shape, a third surface defining an underside of the triangular shape, and having a pair of truss notches at positions corresponding respectively to the pairs of notches of the first member, for each engaging with one of the plurality of separate members, a plurality of feature hooks, formed on the first and second surfaces, for engaging with the fourth member, and wherein the fourth member is a planar roofing material having a plurality of holes, to engage the feature hooks on one of the first and second surfaces of the third member;

wherein the notches formed on the first member, the second member, and the third member each comprise a pin formed within one of the first and second notches, the pin being formed to be received within a respective mating hole on one of the plurality of separate members, to engage the separate member and the respective separate member together wherein the notches formed on the first member, the second member, and the third member each comprise the mating hole formed within the respective other of the first and second notches, the mating hole being formed to receive a respective pin formed on one of the plurality of separate members, to engage the separate member and the respective separate member together;

wherein the first member further comprises at least one additional mating hole formed in a surface of the elongated body portion at a horizontal plane spaced vertically from the horizontal plane of a bottom surface of the first and second notches and at a position between the first and second notches of the first and second ends, for receiving a respective pin formed on one of the plurality of separate members, to engage the first member and the respective separate member together.

2. The system of claim 1, wherein the pin has one of a cylindrical cross-section, a rectangular cross-section, or a triangular cross-section.

3. The system of claim 1, wherein the pin has a diameter of between 0.25 inches and 3 inches.

4. The system of claim 1, further comprising a temporary structure formed by a plurality of first members where alternate said first members are connected at a 90-degree angle by engaging respective said notches on each of the first members, to form a corner structure.

5. The system of claim 1, further comprising a temporary structure formed by a plurality of the first members and the second members where the first members are stacked in alignment of each elongated body portion with the second members oriented at 90-degrees so that the first and second members are engaged in respective notches, to form a wall structure.

6. The system of claim 1, wherein the feature hooks each have a c-shape hook profile to engage edges of the respective holes of the fourth member.

7. The system of claim 1, wherein the third member includes a front surface with longitudinally-extending grooves that add strength to the third member.

8. The system of claim 1, wherein the first member includes a third pair of first and second notches formed substantially along a center of the elongated body portion, wherein each of the notches engages with one of the plurality of separate members.

9. The system of claim 1, wherein the second member comprises a pivot formed on one of the first or second ends, wherein the pivot is configured to engage a respective hinge formed on a fifth member of the plurality of separate members.

10. The system of claim 9, wherein the hinge of the fifth member comprises first and second projections, formed on opposite ends of the hinge, for engaging respective pivots formed on a spaced-apart pair of said second members.

11. The system of claim 10, wherein the fifth member comprises a shutter.

12. The system of claim 10, wherein the fifth member comprises a door.

13. The system of claim 1, wherein the fourth member includes the plurality of holes substantially adjoining opposite ends so that the fourth member can engage the feature hooks on opposite said third members, to form a single roof section.

14. The system of claim 1, wherein the fourth member is a roof panel having opposite ends each having a single hole to engage respective said feature hooks on opposite said third members, wherein a plurality of said roof panels form a roof section.

15. The system of claim 8, wherein the roof panel is a first roof panel and wherein at least one of the opposite ends of the first roof panel is a half thickness end, for overlapping with a half thickness end of a second roof panel, such that single holes of the respective half thickness ends are aligned on the first and second roof panels, for both engaging a same feature hook.

* * * * *